United States Patent [19]

Booty, Sr. et al.

[11] Patent Number: 4,790,766

[45] Date of Patent: Dec. 13, 1988

[54] ELECTRICAL POWER TRACK SYSTEM

[76] Inventors: Donald J. Booty, Sr., 521 Durham Dr., Frankfort, Ill. 60423; Donald J. Booty, Jr., 360 E. Randolph, Apt. 1603, Chicago, Ill. 60601

[21] Appl. No.: 33,397

[22] Filed: Apr. 1, 1987

[51] Int. Cl.[4] ..... H01R 25/14

[52] U.S. Cl. ..... 439/122; 439/117

[58] Field of Search ..... 439/110–122, 439/207–216

[56] References Cited

U.S. PATENT DOCUMENTS

| | | | |
|---|---|---|---|
| 3,757,273 | 9/1973 | Hesse | 439/117 |
| 3,825,879 | 7/1974 | Hesse | 439/117 |
| 3,848,715 | 11/1974 | Hesse | 439/119 |
| 3,993,385 | 11/1976 | Seger | 439/122 |
| 4,508,400 | 4/1985 | Herbert | 439/207 |

FOREIGN PATENT DOCUMENTS

| | | | |
|---|---|---|---|
| 2210516 | 9/1973 | Fed. Rep. of Germany | 439/207 |
| 2250737 | 4/1974 | Fed. Rep. of Germany | 439/207 |
| 2411976 | 2/1976 | Fed. Rep. of Germany | 439/207 |

*Primary Examiner*—Gil Weidenfeld
*Assistant Examiner*—Gary F. Paumen
*Attorney, Agent, or Firm*—Welsh & Katz, Ltd.

[57] ABSTRACT

An electrical power track system includes an elongated tubular track carrying elongated electrical conductors internally thereof and having a relatively narrow longitudinally extending slot formed in the track to enable access to the conductors but inhibiting insertion of fingers and the like into the track. A gripper device is adapted for mounting on the track and has a thin fin-like extension adapted for insertion into the track slot. The gripper device carries descrete electrically conductive L-shaped contacts spaced along the fin-like extension for movement between retracted positions within the extension to enable insertion into the track slot, and extended positions engaging the track conductors when the gripper device is mounted on the track. An actuator carried by the gripper device enables selective movement of the contacts between their retracted and extended positions, and a locking member releasably secures the gripper device on the track.

19 Claims, 1 Drawing Sheet

ELECTRICAL POWER TRACK SYSTEM

BACKGROUND OF THE INVENTION

The present invention relates generally to electrical power track systems, and more particularly to an electrical power track system such as employed in track lighting systems and which employs novel track and gripper or tap elements cooperative to enable use of an elongated power track having a relatively narrow longitudinal slot allowing indirect access to electrical conductors within the track and providing enhanced appearance and improved safety over prior power track systems.

Electrical power track systems of the type employing an elongated track having a plurality of longitudinally extending conductors or bus bars carried within the track and accessible through a longitudinal slot or channel formed in the track to enable releasible engagement by a gripper or tap member carrying electrical power contacts are generally known. See, for example, U.S. Pat. Nos. 3,639,885 to Yoshiya, 3,832,503 to Crane, 4,032,208 to Berkenhoff and 4,181,388 to Donato.

A common drawback of such known track lighting systems is that the longitudinal slots or channels formed in the tracks to provide access to the internal conductors detract from a clean smooth appearance and lead to significant safety hazards due to the ease with which fingers or a conductive element, such as a screwdriver or the like, may be inserted into the open slot or channel in a manner to contact an electrical conductor within the track.

In the known power track systems, the transverse width of the access slot or channel in the track is determined by the configuration of the corresponding gripper or tap device which supports an electrical device such as a lamp or the like and carries contact means for insertion into the track to engage the power conductors carried within the track. For the most part, the prior gripper or tap devices employ a stem-like extension which is inserted into the track channel and carries a locking element and a plurality of electrical contacts which are caused to engage the track and internal conductors through a camming or rotational movement imparted to the extension or to components thereof after insertion into the track. Because the gripper, or at least the stem extension thereof, is conventionally made of an electrically non-conducting material such as plastic or the like, it must be of relatively large size in order to provide the needed strength and support for the corresponding locking element and electrical contacts. It follows that the relatively large size of the gripper extension requires a correspondingly wide width slot or channel in the track to enable insertion of the gripper extension into the slot. Such wide width slots not only provide a rather unattractive appearance, but more importantly allow the insertion of conductive elements or a child's fingers into the track and accidental contact with the electrical conductors within the track, thus presenting a significant safety hazard. Accordingly, a power track system employing a track having a relatively narrow longitudinal access slot or channel and a gripper device cooperative with the narrow slot track would enhance the visual appearance of the track and provide improved safety by inhibiting insertion of an electrically conductive instrument or a child's fingers into the slot in a manner to contact the track conductors.

SUMMARY OF THE INVENTION

A general object of the present invention is to provide an electrical power track system employing a novel track and gripper device which provide improved appearance and safety through inhibiting accidental insertion of fingers or a conductive instrument into an open slot or channel in the track in a manner to engage electrical conductors carried within the track.

A more particular object of the present invention is to provide an electrical power track system employing novel track and gripper elements wherein the track has a relatively narrow longitudinal access slot formed therein and carries internal elongated conductor elements offset from the access slot, the gripper element having a thin fin-like extension adapted for insertion into the track slot and carrying discrete electrical contacts along the length of the extension for movement by means of a manually operable actuator between retracted positions disposed within the fin-like extension and extended positions engaging the conductors within the track, the gripper extension also carrying a locking element operative to releasably secure the gripper element to the track.

A feature of one embodiment of the power track system in accordance with the invention lies in the employment of an actuator which is carried by the gripper device and is longitudinally movable to effect simultaneous movement of the electrical contacts and locking element between their retracted positions within the fin-like extension and outwardly extending positions upon insertion of the fin-like extension into the track slot so as to secure the gripper device to the track and establish an electrical circuit to an electrical load carried by the gripper device.

Another feature of the power track system in accordance with the invention lies in the provision of a power track and cooperating gripper device which enable a relatively narrow longitudinal access slot or channel to be formed in the track so as to provide an aesthetically clean and uncluttered appearance.

Further objects, advantages and features of the invention, together with the organization and the manner of operation thereof, will become apparent from the following detailed description of the invention when taken in conjunction with the accompanying drawings wherein like reference numerals designate like elements throughout the several views.

DETAILED DESCRIPTION

Figure 1:
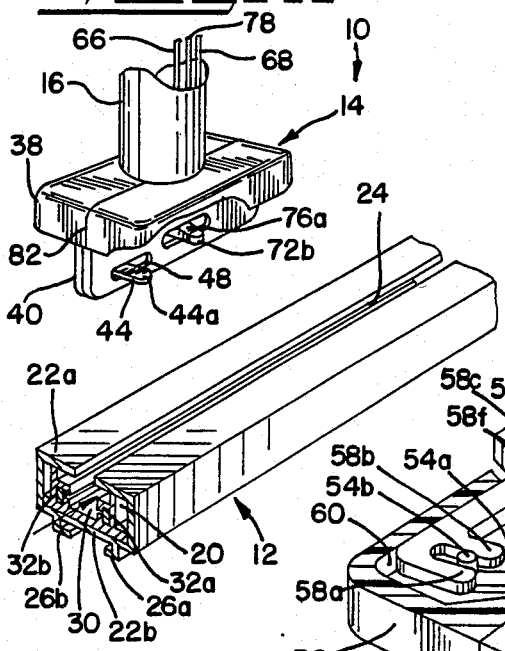
FIG. 1 is a fragmentary perspective view illustrating an electrical power track and gripper device constructed in accordance with the present invention, the gripper device being removed from the track and having portions broken away for clarity.

Referring now to the drawing, an electrical power track system constructed in accordance with the present invention is indicated in FIG. 1 generally at 10. The power track system 10 includes an elongated power track 12 adapted to be mounted on a support surface (not shown) such as a ceiling, wall or floor surface, or other support means, and a gripper device 14 adapted to support an electrical load, such as a lamp or other electrically powered device, through a support stem 16. As will be described, the gripper device 14, which may be termed the gripper element or base, is adapted to be releasably mounted on the track 12 and carries electrical contacts adapted to engage elongated conductors or bus bars carried within the track 12 so as to establish an electrical circuit to an electrical load (not shown) supported on the distal end of the stem 16. When one or more of the gripper devices 14 are employed to support lights or lamps, the gripper devices and power track are conventionally referred to as a track lighting system.

The elongated track 12 is preferably formed from a suitable metallic material but may be made from an electrically nonconductive material such as plastic or the like. The track 12 is formed as a tubular track having a substantially rectangular transverse cross-sectional configuration so as to establish an internal longitudinal cavity or chamber 20. In the illustrated embodiment, the track 12 defines parallel upper and lower generally planar surfaces **22*a* and 22*b*, respectively, and laterally opposite sidewall surfaces 22*c* and 22*d* lying in planes normal to the upper and lower surfaces. The upper planar surface 22*a* has a relatively narrow longitudinally extending slot or channel 24 formed centrally along its full length so as to provide access to the internal chamber 20. The lower surface 22*b* has a pair of longitudinally extending oppositely facing L-shaped members 26*a* and 26*b* which are spaced inwardly from their corresponding track sidewall surfaces 22*c* and 22*d* and provide means to facilitate mounting of the track 12 on a support surface, such as a wall, ceiling or the like, through suitable mounting plates selectively spaced along the length of the track. It will be appreciated that while the track 12 is shown with the surface 22*a* and associated slot or channel 24 facing upwardly, the channel may frequently be mounted in a manner such that the surface 22*a* faces in a downward orientation or lies in a generally vertical orientation. Thus, the designation of surfaces 22*a* and 22*b*** as upper and lower surfaces is for illustration purposes only.

Figure 4:
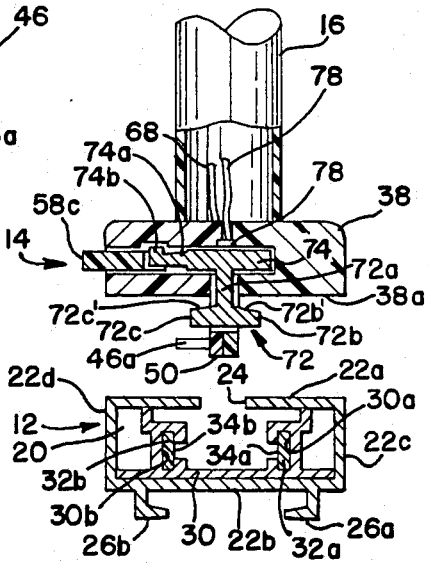
FIG. 4 is a fragmentary transverse sectional view through the power track and gripper device of FIG. 1 at approximately midlength of the gripper device.

Referring to FIGS. 1 and 4, an elongated electrically nonconducting insulator member 30, which may be made of extruded plastic or the like, is supported within track 20 and defines a pair of laterally opposed longitudinally extending grooves **30*a* and 30*b* which receive and support elongated electrical conductors 32*a* and 32*b*. The conductors 30*a* and 30*b* are preferably of generally rectangular transverse cross-sectional configuration and are supported within the insulator member 30 so as to lie in generally parallel planes spaced from the longitudinal center of track 12 in laterally offset relation from the longitudinal slot or channel 24**.

The conductors **32*a* and 32*b* have opposed contact surfaces 34*a* and 34*b*, respectively, which are spaced sufficiently from a longitudinal median plane normal to the upper surface 22*a* of the track so as to substantially prevent direct access to the conductors 32*a,b* by generally straight-in insertion of a conductive instrument, such as a screwdriver, into the slot 24. The slot 24** is also sufficiently narrow to prevent insertion of a child's fingers or the like, thus preventing accidential or inadvertent human contact with the conductors through the access slot.

The gripper device 14 is preferably made from a suitable non-conductive material such as molded plastic and has a generally rectangular shaped base 38 to which the tubular stem is affixed as by being formed integral therewith. The rectangular gripper base 38 has a generally planar track engaging surface **38*a* from which a fin-like extension 40 projects in normal relation to surface 38*a*. The fin-like extension 40 is of generally rectangular configuration and is relatively narrow in transverse width so as to enable insertion into the narrow slot 24 in the track. Extension 40 projects from the gripper base surface 38*a* a distance sufficient to extend between the conductors 32*a,b* within the track when inserted through slot 24 with gripper base surface 38*a* engaging track surface 22*a***.

Figure 2:
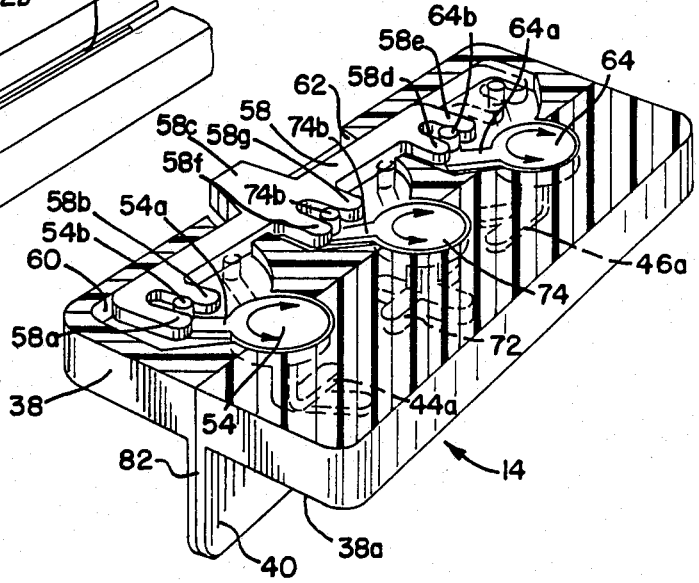
FIG. 2 is a perspective view of the gripper device of FIG. 1 but on an enlarged scale and with portions broken away for purposes of clarity.
Figure 3:
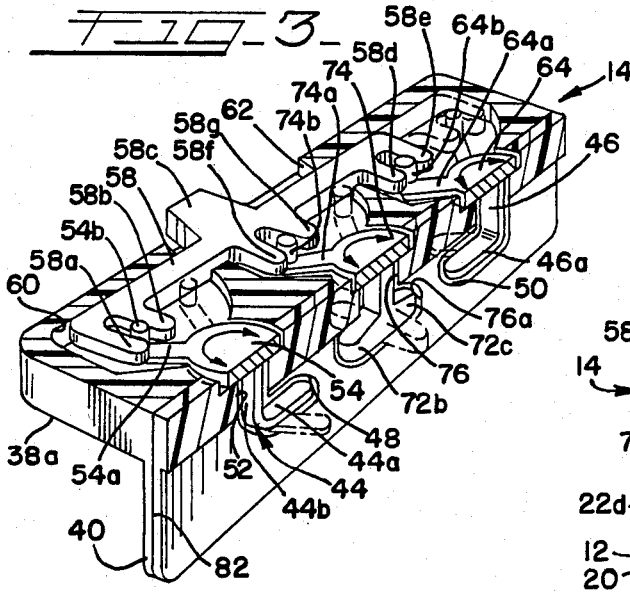
FIG. 3 is a perspective view similar to FIG. 2 but with further portions broken away for clarity.

In accordance with one feature of the invention, the gripper base 38 and associated extension 40 cooperate to support a plurality of L-shaped electrically conductive contacts which are movable between retracted positions within the fin-like extension 40 during insertion of the extension into track slot 24, and second extended positions wherein the contacts engage the track conductors **32*a,b* after insertion into the track. To this end, the gripper base 38 and extension 40 support a pair of discrete spaced L-shaped electrically conductive metallic contacts 44 and 46 having arm portions 44*a* and 46*a*, respectively, adapted for movement between first retracted positions disposed within corresponding elongated openings or recesses 48 and 50 formed in opposite side surfaces of the fin-like extension 40, and outwardly extending positions disposed substantially at right angles to extension 40. Contact 44 has a second arm portion 44*b* which extends through an internal passage or bore 52 in the extension 40 and has its upper end affixed centrally to an electrically conductive circular metallic plate or disk 54 supported within the gripper base in a manner to allow rotation about the axis of arm portion 44*b*. In the illustrated embodiment, disk 54 has an arm 54*a* extending generally radially therefrom the outer end of which has an upstanding boss 54*b* formed thereon. The boss 54*b* is received between fingers 58*a* and 58*b* of an actuator member 58 which is longitudinally slidable within a suitable recess 60 formed in the gripper base 38. Actuator member 58 has a projection 58*c* formed thereon which projects outwardly through a suitable slot 62 in the gripper base so as to enable manual longitudinal reciprocating movement of the actuator. In this manner, movement of actuator member 58 from a position as shown in solid lines in FIGS. 2 and 3 to an opposite end position, as shown in phantom, is operative to effect clockwise movement of the disk 54 and associated contact 44 whereby to cause arm 44*a* to rotate outwardly from its corresponding recess 48 to a position generally normal to the fin-like projection 40**.

In similar fashion, electrical contact 46 has an arm portion **46*b* supported for rotation within the extension 40 and has an electrically conductive metallic disk 64 affixed to its upper end within the gripper base 38. Disk 64 has an arm 64*a* and upstanding boss 64*b* formed therewith which cooperate with fingers 58*d* and 58*e* on the actuator 58 so as to effect movement of the conductive arm 46*a* from its retracted position within recess 50** to an outwardly extending position generally normal to extension 40 upon the aforementioned movement of the actuator 58. It is noted that the conductive arm 46*a* extends in a direction opposite to the contact arm 44*a* when in their recessed positions so that when the disks 54 and 64 undergo clockwise rotation, the arm 46*a* extends outwardly from the opposite side of the fin-like projection 40 from contact arm 44*a*. Both contacts 44 and 46 are configured such that when the fin-like projection 40 is inserted into track 12 through slot 24 and the actuator 58 is moved longitudinally as aforedescribed, the contact arms 44*a* and 46*a* will each engage a selected one of the track conductors 32*a* and 32*b*.

A pair of electrical conductors, indicated at 66 and 68 in FIG. 1, are supported within the gripper base 38 such that a contact end of conductor 66 slidably engages the upper surface of disk 54 and a contact end of conductor 68 slidably engages the upper surface of disk 64. The conductors 66 and 68 extend upwardly through the stem 16 for connection to an electrical load and thereby provide an electric power circuit to the load from the contacts 44 and 46 when they engage power conductors 32*a* and 32*b* within track 12.

In the preferred embodiment, the gripper device 14 includes track locking means in the form of a generally T-shaped locking member 72 which is separate from and positioned intermediate the contacts 44 and 46 within the extension 40. Locking member 72 has a stem 72*a* which is affixed centrally and normal to a circular plate or disk 74 rotatable within the gripper base 38 similar to disks 54 and 64. Disk 74 has an arm 74*a* on which is formed an upstanding boss 74*b* received between fingers 58*f* and 58*g* of the actuator 58 so as to effect a corresponding and simultaneous rotation of disk 74 with disks 54 and 64 upon longitudinal movement of actuator 58. The stem 72*a* of locking member 72 is rotatable within a bore 76 formed in the fin-like extension 40 and has a pair of locking arms 72*b* and 72*c* extending generally equal radial distances from the axis of stem 72*a*. An elongated open slot 76*a* is formed through the extension 40 generally normal to and intersecting bore 76. Slot 76*a* is of sufficient size to enable the locking arms 72*b* and 72*c* to be received in recessed positions within the slot 76*a* when the contact arms 44 and 46 are in their recessed positions.

The locking arms 72*b* and 72*c* and their associated slot 76*a* are positioned so that when the fin-like extension 40 is inserted into the narrow track slot 24 with the gripper base surface 38*a* engaging track surface 22*a*, longitudinal movement of actuator 58 moves the contact arms 44 and 46 to their operative extended positions engaging the track conductors 32*a,b*, and simultaneously extends the locking arms 72*b* and 72*c* to underlie the upper wall of the track adjacent the slot 24 such that cam surfaces 72'*b* and 72'*c* wedge the upper track wall against the gripper base surface 38*a* and thereby releasably lock the gripper base in fixed relation on the track. An electrical conductor 78 is supported within the gripper base 38 such that a contact end 78*a* (FIG. 4) electrically engages the conductive disk 74. The opposite end of conductor 78 extends through the stem 16 to provide an earth ground for the electrical load to which the conductors 66 and 68 are connected. Any current passed through the ground conductor 78 will be conducted to the metallic track 12 which will be grounded in the usual manner. Alternatively, a third longitudinal ground conductor (not shown) could be supported by the insulator member 30 within the track and positioned for engagement with the conductive locking member 72 to provide a suitable ground for an electrical load connected to the conductor 66 and 68.

When the gripper device 14 is mounted on the power track 12 with the extension 40 inserted into slot 24 and with the contacts 44 and 46 engaging track conductors 32*a,b* and locking member 72 in locking relation with the track, it will be appreciated that reverse movement of the actuator 58 will effect retraction of the contact arms 44*a*, 44*b* and locking arms 72*b,c* into their respective recesses 48, 50 and 76*a* in the fin-like extension 40 to enable release of the gripper device 14 from the track and repositioning thereon if desired. The gripper base 38 and associated extension 40 may be made of a molded plastic material. For example, the gripper base, extension 40 and, if desired, stem 16 may be formed as two molded halves having, when assembled, a common parting plane as indicated at 82 in FIGS. 1–3.

As an alternative to the longitudinally movable actuator 58, actuation means in the form of a thumb actionable disk could be mounted within the gripper base 38 for rotation about an axis parallel to the axes of rotation of the disks 54, 64 and 74. Such a thumb disk or wheel could readily be interconnected to any one of the disks 54, 64 or 74, as through a spur gear interconnection, with the actuated disk 54, 64 or 74 then being interconnected to the other disks through similar spur gear connections in a manner to obtain the desired movement of contacts 44 and 46 and locking member 72 upon rotation of the thumb wheel.

Thus, in accordance with the present invention, an electrical power track system is provided which finds particular application in track lighting and which employs an elongated preferably metallic track having a relatively narrow slot formed therein to provide access to conductors carried within the track in offset relation to the access slot. The system includes a gripper device having a relatively thin fin-like extension adapted for insertion into the narrow track slot and carrying separate and distinct electrical contacts spaced along its longitudinal length for movement between retracted positions within the fin-like extension and extended positions operative to engage the conductor elements within the track upon selective movement of actuator means carried by the gripper base. Locking means carried by the gripper base are also operable in response to actuation of the actuator means to releasably lock the gripper base to the track. By providing a relatively narrow longitudinal access slot in the track, inadvertent and hazardous insertion of a conductive instrument or a child's fingers into the track in a manner enabling contact with the electrical track conductors is inhibited, thus providing a significant safety improvement over the known power track systems.

While preferred embodiments of the present invention has been illustrated and described, it will be understood that changes and modifications may be made therein without departing from the invention in its broader aspects. Various features of the invention are defined in the following claims.

What is claimed is:

1. An electrical power track system comprising, in combination, an elongated tubular track adapted to be supported on a support surface and defining an exposed mounting surface, said mounting surface having a relatively narrow longitudinally extending slot formed therein, a plurality of elongated generally longitudinally extending electrical conductors carried internally of said track in offset relation from and accessible through said slot, a gripper device having a base portion defining a track engaging surface adapted for engagement with said track mounting surface, said gripper device having a relatively narrow generally rectangular fin-like extension projecting outwardly from said track engaging surface and adapted for insertion into said slot in said track, said gripper device carrying at least two discrete electrically conductive generally L-shaped contact members spaced longitudinally along said extension and adapted for rotational movement about an axis substantially normal to said track engaging surface, each of said L-shaped contact members having a contact arm movable in response to rotation of the corresponding contact member between a retracted position within said extension to enable insertion of said extension into said slot, and an extended position engaging a selected one of said electrical conductors when said extension is inserted into said slot, and an actuator member carried by said gripper device for movement longitudinally thereof, said actuator member being interconnected to said contact members so as to effect rotational movement of said contact arms between their said retracted and extended positions upon selective movement of said actuator member, said actuator member being manually graspable and manipulable from the exterior of said gripper device.

2. An electrical power track system as defined in claim 1 wherein said track is metallic and has a substantially rectangular transverse cross sectional configuration, and including an insulator member disposed within said track and supporting said elongated electrical conductors in laterally offset relation from said longitudinal slot.

3. An electrical power track system as defined in claim 2 wherein said insulator member supports a pair of elongated conductors within said track so as to define laterally opposed conductor contact surfaces, said contact arms of said contact members carried by said gripper device being operative to extend outwardly from opposite sides of said extension so as to engage a selected one of said conductors when moved to their said extended positions with said gripper device mounted on said track.

4. An electrical power track system as defined in claim 1 wherein said gripper device carries locking means adapted for movement between a retracted position within said fin-like extension and an extended position cooperative with said track to releasably secure said gripper device on said track.

5. An electrical power track system as defined in claim 4 wherein said locking means comprises a locking member positioned along said fin-like extension in longitudinally spaced relation to said conductive contact members, said locking member being interconnected to said actuator member and movable between its said retracted and extended positions in response to selective longitudinal movement of said actuator member.

6. An electrical power track system as defined in claim 5 wherein said locking member is positioned intermediate said conductive contact members.

7. An electrical power track system as defined in claim 1 wherein said fin-like extension has recesses formed therein adapted to receive said contact arms when disposed in their said retracted positions, said contact arms extending at generally right angles to said extension when in their said extended positions so as to engage said track conductors when said gripper device is mounted on said track with said extension inserted into said slot.

8. An electrical power track system as defined in claim 7 wherein said gripper device carries a locking member adapted to releasably lock said gripper device to said track when mounted thereon.

9. An electrical power track system as defined in claim 8 wherein said locking member is generally T-shaped and defines a pair of oppositely extending locking arms cooperative with said track to releasably lock said gripper device on said track.

10. An electrical power track system as defined in claim 9 wherein said locking arms include cam surfaces operative to urge said gripper device against said track mounting surface when in locking relation with said track.

11. An electrical power track system as defined in claim 1 including further electrical conductors carried by said gripper device and conductively coupled to said discrete conductive contacts to establish an electrical circuit through said gripper device.

12. A track lighting system comprising, in combination, an elongated track adapted to be supported on a support surface and having an exposed mounting surface, a relatively narrow longitudinal slot formed in said mounting surface, at least two elongated electrical conductors carried internally of said track in laterally offset relation from and accessible through said slot, a gripper device having a base portion defining a relatively planar track engaging surface and having a relatively thin fin-like generally rectangular extension projecting from said track engaging surface and adapted to be inserted into said slot in said track, said gripper device supporting at least two separate and distinct electrical contact members each of which includes a conductive plate supported within said base portion for rotation about an axis of rotation normal to the plane of said track engaging surface, and an L-shaped conductive contact having a first arm portion secured in normal relation to a corresponding plate for rotation about said rotational axis, each first contact arm extending into said fin-like extension and having a second arm portion fixed normal thereto for movement between a first retracted position disposed within said fin-like extension and a second position extending from said extension so as to engage said electrical conductors within said track when said gripper base is mounted on said track, and an actuating member carried by and extending longitudinally of said base portion of said gripper device, said actuating member being interconnected to said conductor plates and longitudinally movable to enable selective movement of said second contact arm portions between their said first and second positions.

13. A track lighting system as defined in claim 12 including locking means carried by said gripper device and defining locking arms movable from retracted positions within said fin-like extension and extended positions operative to releasably secure said gripper device on said track in response to actuation of said actuating member.

14. A track lighting system as defined in claim 13 wherein said locking means comprises a T-shaped locking member defining a pair of oppositely projecting locking arms adapted for locking cooperation with said track when said gripper device is mounted thereon.

15. A track lighting system as defined in claim 14 wherein said T-shaped locking member is electrically conductive.

16. A track lighting system as defined in claim 15 wherein said electrical contacts and said locking member are cooperative to establish an electrical circuit to an electrical load device carried by said gripper device.

17. A track lighting system as defined in claim 12 wherein each of said electrical contact members has a radial arm fixed to and projecting from the corresponding conductive plate, said actuating member having pairs of fingers cooperative with corresponding ones of said radial arms such that longitudinal movement of said actuating member effects a corresponding rotational movement of the associated conductive plate and associated L-shaped conductive contact.

18. A track lighting system as defined in claim 12 wherein said longitudinal slot formed in said track has a transverse width sufficiently narrow to prevent entry of an infant's finger.

19. A track lighting system as defined in claim 12 wherein said fin-like extension and said at least two electrical contact members are cooperative such that said second arm portions of said conductive contacts extend outwardly from opposite sides of said extension when in their said second positions.

* * * * *